US005082523A

United States Patent [19]

Walker

[11] Patent Number: 5,082,523

[45] Date of Patent: Jan. 21, 1992

[54] PROCESS OF REGENERATING SPENT HF-$HNO_3$ PICKLE ACID CONTAINING $(ZRF_6)^{-2}$

[75] Inventor: Roy G. Walker, Ogden, Utah

[73] Assignee: Westinghouse Electric Corp., Pittsburgh, Pa.

[21] Appl. No.: 615,675

[22] Filed: Nov. 19, 1990

[51] Int. Cl.[5] ..... B44C 1/22; C23F 1/00

[52] U.S. Cl. ..... 156/642; 134/13; 134/41; 156/664; 156/345

[58] Field of Search ..... 156/642, 656, 664, 345; 134/3, 10, 13, 41; 252/79.3

[56] References Cited

U.S. PATENT DOCUMENTS 3,048,503 8/1962 Foot ..... 134/9
4,105,469 8/1978 Megy ..... 134/3
4,144,092 3/1979 Krepler ..... 134/12
4,330,342 5/1982 Fennemann ..... 134/13
4,526,650 7/1985 Blomquist ..... 156/642
4,738,747 4/1988 Panson ..... 156/642

*Primary Examiner*—William A. Powell
*Attorney, Agent, or Firm*—J. C. Valentine

[57] ABSTRACT

Spent HF-$HNO_3$ pickle acid containing $(ZrF_6)^{-2}$ is regenerated by the addition of $NaNO_3$ to precipitate $Na_2ZrF_6$. The $Zr^{+2}$ concentration of the pickle acid may be reduced from about 25 gram/liter to about 1 gram/liter with an increase in $Na_+$ concentration of less than about 200 ppm. The relatively pure pickle acid containing zirconium and sodium may be recycled to pickle zirconium based articles or may be fed to a zirconium recovery process.

6 Claims, 1 Drawing Sheet

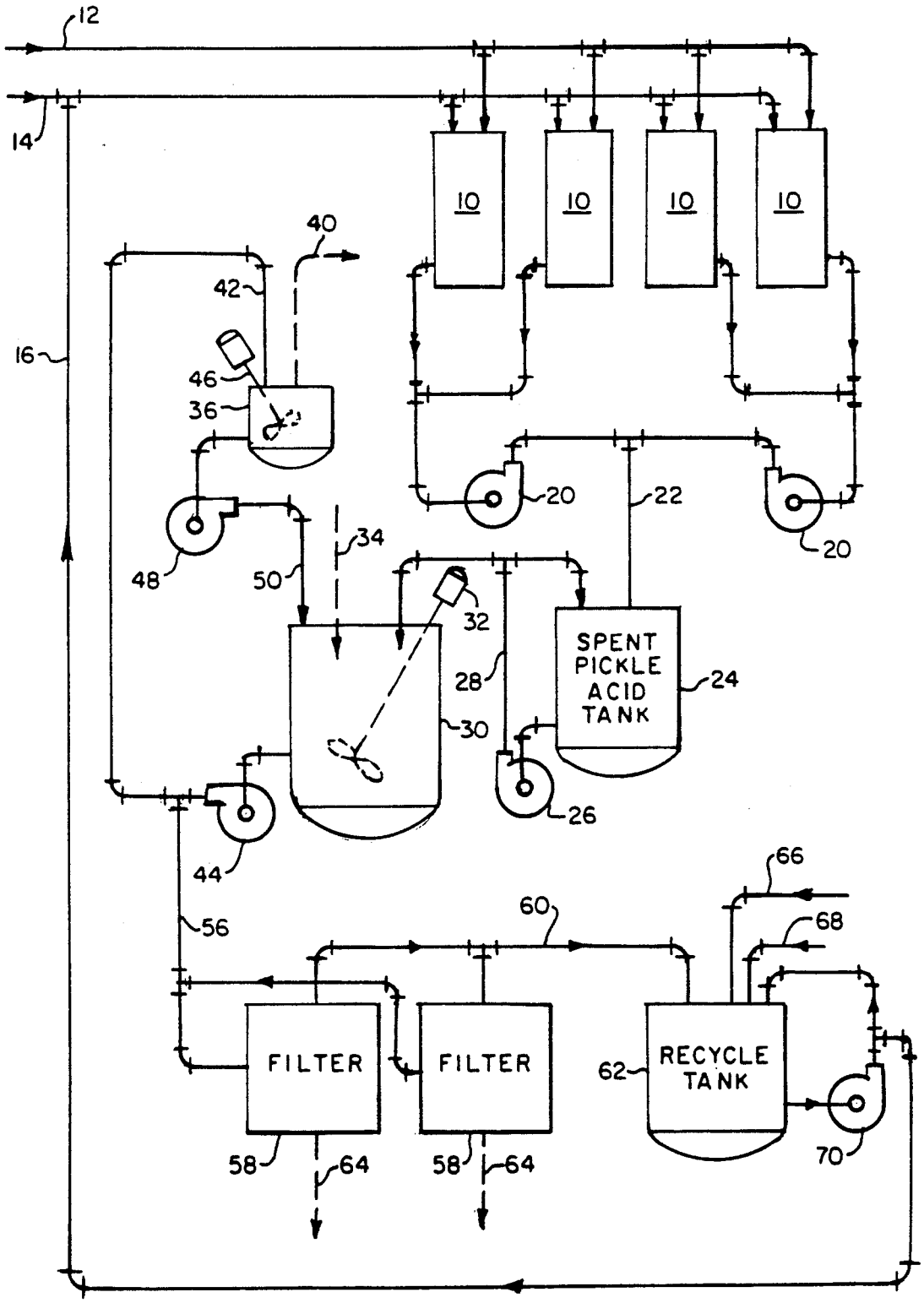
12
14
16
10
10
10
10
40
42
46
36
20
22
20
48
50
34
32
28
SPENT PICKLE ACID TANK
24
30
26
44
66
60
68
56
FILTER
FILTER
62
RECYCLE TANK
58
64
58
64
70

PROCESS OF REGENERATING SPENT HF-$HNO_3$ PICKLE ACID CONTAINING $(ZRF_6)^{-2}$

BACKGROUND OF THE INVENTION

This invention relates to a process of regenerating spent HF-$HNO_3$ pickle acid containing $(ZrF_6)^{-2}$. It is particularly useful for regenerating spent acids employed to pickle zirconium based articles.

Mixed acids such as HF-$HNO_3$ solutions are widely employed to pickle articles made of zirconium, titanium, iron and their alloys. As the pickling solutions etch the surfaces of the articles, the concentration of the etched metal eventually increases to a level where the pickling rate becomes unacceptably low. The spent acid solutions must then be regenerated by precipitating the metals to lower their concentrations in the solutions and, if necessary, then recharging by adding fresh HF and/or $HNO_3$ to restore their nominal concentrations before being recycled to the pickling lines. Presently known regeneration processes are disclosed by U.S. Pat. Nos. 3,048,503; 4,105,469; 4,144,092; 4,330,342; 4,526,650 and 4,738,747 and also U.S. application Ser. No. 07/555,333, filed 07/19/90, (W.E. 54,825) on behalf of the assignee of the present invention, which are hereby incorporated by this reference.

U.S. Pat. Nos. 4,105,469 and 4,330,342 disclose processes for adding NaF to spent HF-$HNO_3$ pickle acids containing $(ZrF_6)^{-2}$ to precipitate $Na_2ZrF_6$. U.S. Pat. No. 4,105,469 discloses the addition of crystalline NaF to spent acids. However, NaF is a rather expensive precipitant and has a low solubility. Insufficient additions of NaF may lead to the formation of $NaZrF_5.H_2O$, which is a difficult-to-filter, gel-like material. On the other hand, excessive additions of NaF may lead to premature precipitation of $Na_2ZrF_6$ because of the excess $Na^+$ and $F^-$ in solution, which may interfere with the pickling step. U.S. Pat. No. 4,330,342 discloses the addition of NaOH solutions to the spent acids to generate NaF in solution rather than adding NaF in crystalline form. Such additions of highly basic solutions into highly acidic solutions must be carefully performed to prevent local corrosion or other damage to the processing equipment and injury to the operating personnel.

U.S. Ser. No. 07/555,333, (W.E. 54,825) discloses a process for adding $Na_2SO_4$ and $CaF_2$ to spent HF-$HNO_3$ pickle acids containing $(ZrF_6)^{-2}$ to precipitate $Na_2ZrF_6$. First, the $Na_2SO_4$ is added to precipitate $Na_2ZrF_6$ and then the $CaF_2$ is added to precipitate $CaSO_4$ and to increase the $F^-$ concentration of the regenerated acid. Thus, this process produces two precipitates for disposal and introduces two additional process variables, i.e., $Ca^{+2}$ ions and $SO_4^{-2}$ ions in the pickle acid. Also, he presence of $SO_4^{-2}$ ions or other extraneous ions in the system may require special treatment whether the pickle acid and/or $Na_2ZrF_6$ is treated as a waste product or a useful material.

SUMMARY OF THE INVENTION

It is an object of the present invention to regenerate spent HF-$HNO_3$ pickle acids containing $(ZrF_6)^{-2}$ by adding precipitating agents which do not generate difficult-to-filter precipitates. It is also an object of the present invention to precipitate $Na_2ZrF_6$ with precipitating agents which do not introduce additional anions into the process which might contaminate the $Na_2ZrF_6$ precipitate or the pickle acid.

With these objects in view, the present invention resides in an improved process for regenerating a spent HF-$HNO_3$ pickle acid containing $(ZrF_6)^{-2}$ so that the pickle acid may be recycled to pickle zirconium-containing articles or employed in other processes. In the practice of the improved process, $NaNO_3$ is added to spent pickle acid to precipitate $Na_2ZrF_6$. The $Na_2ZrF_6$ precipitate is then separated from the pickle acid by filtration or settling. In a preferred practice, the pickle acid contains about 4 wt. % HF and 42 wt. % $HNO_3$. The addition of sufficient $NaNO_3$ to this pickle acid containing about 25 grams Zr/liter effectively reduces the concentration of $Zr^{+2}$ to about 1 gram/liter and produces a $Na_2ZrF_6$ precipitate which is relatively easy to filter.

DESCRIPTION OF THE DRAWING

The present invention will become more readily apparent from the following description of a preferred practice thereof shown, by way of example only, in the accompanying process flow diagram.

DESCRIPTION OF A PREFERRED PRACTICE

Zirconium based articles are pickled in mixed acids nominally containing 35–45 wt. % $HNO_3$ and 1–4 wt. % HF. Preferably, a 4% HF–42% $HNO_3$ pickle acid is employed. Spent pickle acid may also contain up to about 0.5% or more of iron, silica and other impurities.

The process flow diagram generally shows four parallel pickle tanks 10 for pickling zirconium based articles (not shown) such as billets, sheets, tubes and the like which are immersed therein. The tanks 10, which may be agitated or be recirculated, are filled with fresh HF via line 12 and fresh $HNO_3$ via line 14 from a tank farm (not shown). The acids may alternatively be premixed in a makeup tank or in an inline mixer (not shown). In most cases, regenerated pickle acid is recycled via line 16 to the pickle tank 10 to be used and fresh acids are added to fill the tank 10 to the desired level. Over time, etched $Zr^{+2}$ in the form of dissolved $(ZrF_6)^{-2}$ accumulates in the mixed pickling acid and the pickling rate concomitantly decreases to the point where the spent pickling acid must be employed elsewhere (if not contaminated with extraneous ions), disposed of or be regenerated. Preferably, the pickle acid is regenerated.

Spent pickle acid in a pickle tank 10 is pumped via a pump 20 through a line 22 to a holding tank 24, which may be recirculated by a pump 26. Spent pickle acid may be regenerated by pumping the pickle acid from the holding tank through a line 28 into a regeneration tank 30 where the acid is contacted with a $NaNO_3$ solution to precipitate $Na_2ZrF_6$. The regeneration tank 30 preferably is agitated by an agitator 32. The $NaNO_3$ may be added directly to the regeneration tank 30 as is indicated by addition arrow 34 or may be added as a solution. In the case where the pickle acid contains 40 wt. % to 45 wt. % $HNO_3$, the $NaNO_3$ is preferably added as a 30 wt. % to 40 wt. % solution because both streams would have about the same specific gravity to facilitate the mixing in the regeneration tank 30 and precipitation of $Na_2ZrF_6$. The $NaNO_3$ solution is preferably made up periodically in a makeup tank 36 by dissolving $NaNO_3$ as shown by addition arrow 40 in water supplied through line 42. The water in line 42 may be pickle acid which is recycled by a pump 44 as shown, or an aqueous wash solution from a $Na_2ZrF_6$ precipitate filtration step or generally available plant water (not shown). The $NaNO_3$ may be safely and efficiently added to the makeup tank 36, the aqueous solution quickly made up with an agitator 46 and the $NaNO_3$ solution then pumped by pump 48 through line 50 into the regeneration tank 30. A spent 4 wt. % F-42 wt. % $HNO_3$ pickle acid containing about 25 gram $Zr^{+2}$/liter may be regenerated with $NaNO_3$ to provide an acid containing about 1 gram $Zr^{+2}$/liter. Advantageously, the $Na^+$ concentration increases no more than about 200 ppm.

The $Na_2ZrF_6$ precipitate may be permitted to settle from the pickle acid in an unagitated regeneration tank 30 or in a solids settler if the scale of operation justifies the cost of such apparatus. In most cases, it is sufficient to pump the pickle acid and the $Na_2ZrF_6$ precipitate by pump 44 through a line 56 to one of two filters 58, 58, one of which is on-line while the other is being cleaned. The $Na_2ZrF_6$ precipitate is filtered from the pickle acid filtrate which then flows through a line 60 to a recycle tank 62. The $Na_2ZrF_6$ precipitate in the off-line filter 58 may be washed with fresh water (not shown) and then be removed as a filter cake, as is indicated by arrows 64.

The pickle acid in the recycle tank 62 may, if necessary, be recharged with HF and/or $HNO_3$ through lines 66 and 68, respectively, to restore the pickle acid to its nominal concentration. Advantageously, the addition of $NaNO_3$ to the regeneration tank 30 tends to maintain the nitrate concentration. The pickle acid may then be pumped by pump 70 through line 16 to one of the pickle tanks 10 and reused. Alternatively, the pickle acid in the recycle tank 62 is a relatively pure stream and may be employed in other processes because it contains less than about 5 grams $Zr^{+2}$ liter (and preferably about 1 gram Zr/liter), less than about 1 wt % $Na^+$ (and preferably less than 500 ppm) and less than about 1 wt % of other impurities. Thus, for example, the pickle acid may be fed to a process for making zirconium-magnesium master alloys or fed to a zirconium recovery process.

Advantageously, pickle acids regenerated with $NaNO_3$ containing about 35% to 45% $HNO_3$, about 1% to 4% HF and about 1 gram $Zr^{+2}$/liter or less may be cooled down to temperatures as low as −40° F. in, e.g., winter without the post-precipitation of $Zr^{+2}$. Thus, the pickle acid can be transported in tank trucks or through pipes any time of the year without precipitating the $Zr^{+2}$.

While the present invention has been described with specific reference to a practice presently contemplated to be the best mode of practicing the invention, it is to be understood that various changes may be made in adapting the invention to other practices without departing from the broader inventive concepts disclosed herein and comprehended by the following claims.

What is claimed is:

1. A process for regenerating spent HF-$HNO_3$ pickle acid containing $(ZrF_6)^{-2}$, comprising the steps of:

adding $NaNO_3$ to a spent HF-$HNO_3$ pickle acid containing $(ZrF_6)^{-2}$ to precipitate $Na_2ZrF_6$; and separating the HF-$HNO_3$ pickle acid from the $Na_2ZrF_6$ precipitate.

2. The process of claim 1 wherein the separated HF-$HNO_3$ pickle acid contains about 1 gram $Zr^{+2}$/liter.

3. The process of claim 1 wherein the $NaNO_3$ is added to a spent HF-$HNO_3$ pickle acid containing about 25 gram $Zr^{+2}$/liter and reduces its concentration of $Zr^{+2}$ ions to about 1 gram/liter.

4. A process for regenerating spent HF-$HNO_3$ pickle acid containing $(ZrF_6)^{-2}$, comprising the steps of:

forming an aqueous $NaNO_3$ solution;

adding the aqueous $NaNO_3$ solution to spent HF-$HNO_3$ pickle acid containing $(ZrF_6)^{-2}$ in an amount sufficient to precipitate $Na_2ZrF_6$ from the pickle acid;

separating the $Na_2ZrF_6$ from the HF-$HNO_3$ pickle acid.

5. The process of claim 4, wherein the HF-$HNO_3$ pickle acid contains about 40 wt % $HNO_3$ and the $NaNO_3$ solution contains about 20 wt % to about 40 wt % $NaNO_3$.

6. The process of claim 4, wherein the $Na_2ZrF_6$ precipitate is separated from the HF-$HNO_3$ pickle acid by filtration, and wherein the $Na_2ZrF_6$ precipitate is then washed with water to remove $NO_3^-$ions and the $NaNO_3$ is dissolved in the $NO_3^-$ion containing wash water.

* * * * *